US011839312B2

(12) United States Patent
Yang

(10) Patent No.: US 11,839,312 B2
(45) Date of Patent: Dec. 12, 2023

(54) MULTIFUNCTIONAL SMALL DINING CHAIR

(71) Applicant: TJ(fujian) Industrial Co., Ltd., Zhangzhou (CN)

(72) Inventor: Jianbo Yang, Zhangzhou (CN)

(73) Assignee: TJ(fujian) Industrial Co., Ltd., Zhangzhou (CN)

( * ) Notice: Subject to any disclaimer, the term of this patent is extended or adjusted under 35 U.S.C. 154(b) by 0 days.

(21) Appl. No.: 17/709,479

(22) Filed: Mar. 31, 2022

(65) Prior Publication Data

US 2023/0117630 A1 Apr. 20, 2023

(30) Foreign Application Priority Data

Oct. 18, 2021 (CN) ..... 202122503141.3

(51) Int. Cl.
*A47D 1/00* (2006.01)
*A47D 1/02* (2006.01)

(52) U.S. Cl.
CPC ..... *A47D 1/0085* (2017.05); *A47D 1/006* (2013.01); *A47D 1/02* (2013.01)

(58) Field of Classification Search
CPC ..... A47D 1/008; A47D 1/0083; A47D 1/04
USPC ..... 297/148, 153, 154, 31
See application file for complete search history.

(56) References Cited

U.S. PATENT DOCUMENTS 6,264,216 B1 * 7/2001 Wilson ..... B62B 1/00 280/30
2008/0122270 A1 5/2008 Dubiel et al.
2015/0289674 A1 * 10/2015 Winterhalter ..... A47D 1/002 297/16.1
2020/0397150 A1 * 12/2020 Li ..... A47D 1/0085

FOREIGN PATENT DOCUMENTS

CN 107259873 A * 10/2017
CN 110025165 A * 7/2019
EP 0 898 912 A2 * 7/1998
KR 200473560 Y1 7/2014
KR 20210023430 A 3/2021
WO WO-2021009610 A1 * 1/2021 ..... A47D 1/0083

* cited by examiner

*Primary Examiner* — Sarah B McPartlin
(74) *Attorney, Agent, or Firm* — Bayramoglu Law Offices LLC

(57) ABSTRACT

A multifunctional small dining chair includes a front U-shaped support frame, a rear U-shaped support frame, a seat, a backrest, a left armrest, a right armrest and a dining tray. A top of the front U-shaped support frame and a top of the rear U-shaped support frame are arranged in a foldable manner. The seat and the backrest are arranged inside the front U-shaped support frame. The seat and the front U-shaped support frame are arranged in a foldable manner. A bottom end of the backrest and a rear end of the seat are hinged. A rear end of the left armrest and a rear end of the right armrest are connected to an upper front end of the front U-shaped support frame. The dining tray is provided between the left armrest and the right armrest, and the dining tray is rotatable relative to the left or right armrest.

20 Claims, 9 Drawing Sheets

MULTIFUNCTIONAL SMALL DINING CHAIR

CROSS REFERENCE TO THE RELATED APPLICATIONS

This application is based upon and claims priority to Chinese Patent Application No. 202122503141.3, filed on Oct. 18, 2021, the entire contents of which are incorporated herein by reference.

TECHNICAL FIELD

The present invention relates to the field of children's products, and more particularly, to a multifunctional small dining chair.

BACKGROUND

Highchairs are special dining chairs for children. Highchairs can help children develop the habit of sitting while eating and avoid the trouble of chasing a child for feeding. Children can sit steadily in a suitable highchair, and their hands can be freed to grasp tableware, which exercises the coordination of children's hands, eyes, and brain. The prior small dining chairs for children are relatively small in height, which can be placed directly on the ground to match a low dining table, or placed on an adult dining chair to match a normal dining table. With the development of technology, the prior small dining chairs for children are foldable and space-saving, but they still have the problems of single purpose and unfriendly design.

SUMMARY

In order to solve the problem that the prior small dining chairs for children are single-purpose, an objective of the present invention is to provide a multifunctional small dining chair.

To solve the above technical problem, the present invention adopts the following technical solution:

A multifunctional small dining chair includes a front U-shaped support frame, a rear U-shaped support frame, a seat, a backrest, a left armrest, a right armrest and a dining tray, where a top of the front U-shaped support frame and a top of the rear U-shaped support frame are arranged in a foldable manner; the seat and the backrest are arranged inside the front U-shaped support frame; the seat and the front U-shaped support frame are arranged in a foldable manner; a bottom end of the backrest and a rear end of the seat are hinged; a rear end of the left armrest and a rear end of the right armrest are connected to an upper front end of the front U-shaped support frame; and the dining tray is provided between the left armrest and the right armrest, and the dining tray is rotatable relative to the left armrest or the right armrest.

Further, the dining tray may be detachably connected to the left armrest and the right armrest.

Further, a bottom of the dining tray may be provided with a left inserting rod and a right inserting rod; a front end of the left armrest may be provided with a left rod groove into which the left inserting rod may be inserted, and a front end of the right armrest may be provided with a right rod groove into which the right inserting rod may be inserted; a front end of the right inserting rod may be provided with a disc; a right bottom end of the dining tray may be provided with a disc groove adapted to the disc, and the disc may be located in the disc groove; a right end of the disc groove may be open; the disc may be open-top and hollow inside; three arc-shaped through grooves may be uniformly arranged on a bottom of the disc; a protruding post may be provided at a center of an inner bottom surface of the disc; the protruding post may be provided with a shaft hole being vertically hollow; a bottom cover may be provided under the disc; a top surface of the bottom cover may be provided with a lower shaft post and three threaded posts; an inner top surface of the disc groove may be provided with an upper shaft post and three connecting posts; the lower shaft post may be located at a center of the top surface of the bottom cover; the upper shaft post may be located at a center of the inner top surface of the disc groove; a bottom of the upper shaft post may be provided with a first post hole; a top of the lower shaft post passes through the shaft hole to be located in the first post hole; a bottom surface of each of the connecting posts may be provided with a second post hole; each threaded post corresponds to one arc-shaped through groove and one connecting post; a top of each threaded post passes through a corresponding arc-shaped through groove to be located in a corresponding second post hole; and the corresponding connecting post and threaded post may be connected by a screw.

Further, each of the left inserting rod and the right inserting rod may be provided with an elastic clamping button; a bottom of the clamping button passes through a bottom of the left inserting rod and the right inserting rod; each of a bottom surface of the left armrest and a bottom surface of the right armrest may be provided with a clamping button groove; and the bottom of the clamping button may be located in the clamping button groove.

Further, two vertical bars of the front U-shaped support frame may be respectively nested in a left rod sleeve and a right rod sleeve; and the left rod sleeve and the right rod sleeve may be respectively connected to the two vertical bars of the front U-shaped support frame in a liftable manner.

Further, each of a front end surface of the left rod sleeve and a front end surface of the right rod sleeve may be provided with a hinge joint; each of the rear end of the left armrest and the rear end of the right armrest may be provided with a hinge port; the hinge joint may be located in the hinge port and hinged to the rear end of the left armrest or the rear end of the right armrest; a front end surface of the hinge joint may be provided with a first clamping opening; a first movable member may be provided in the hinge port; a bottom of the first movable member may be provided with a push portion; each of a rear bottom of the left armrest and a rear bottom of the right armrest may be provided with a first movement groove; the push portion extends out of the first movement groove; a rear end of the first movable member may be provided with a first clamping portion inserted into the first clamping opening; and a first spring abutting against a front end of the first movable member may be provided in the hinge port.

Further, a support rod may be provided at a middle of a bottom surface of the seat; two ends of the support rod may be provided with clamping posts; a right side surface of the left rod sleeve and a left side surface of the right rod sleeve may be provided with vertical sliding grooves; tops of the vertical sliding grooves may be provided with horizontal clamping grooves communicating with the vertical sliding grooves; the clamping posts may be located in the horizontal clamping grooves, and the clamping posts may slide along the vertical sliding grooves when the seat may be folded; a rear end of the left rod sleeve and a rear end of the right rod sleeve may be provided with extension portions; each of the extension portions may be provided with a clamping hole; a left movement groove and a right movement groove may be provided on the bottom surface of the seat; second movable members may be provided in the left movement groove and the right movement groove; one end of each of the second movable members may be provided with a clamping rod inserted into the clamping hole; the second movable members may be open-top and hollow inside; a second spring may be provided in each of the second movable members; each of the left movement groove and the right movement groove may be provided with an abutting portion and a limiting post, where the abutting portion and the limiting post may be located in each of the second movable members; the second spring may be provided between the clamping rod and the abutting portion; a bottom surface of each of the second movable members may be provided with a step groove; a gasket may be provided in a bottom of the step groove; a bottom of the limiting post may be located inside an upper part of the step groove; and each of the second movable members may be connected to the limiting posts by a screw passing through the gasket.

Further, second movement grooves may be respectively provided in a top of the left rod sleeve and a top of the right rod sleeve; pressing rods may be respectively provided in the second movement grooves; each of top front end surfaces of the pressing rods may be provided with a second clamping portion; each of rear end surfaces of the two vertical bars of the front U-shaped support frame may be provided with a plurality of second clamping openings from top to bottom into which the second clamping portion may be clamped; pressing portions may be provided at bottoms of the pressing rods; rear ends of the pressing portions respectively protrude out of a rear end surface of the corresponding left rod sleeve and a rear end surface of the corresponding right rod sleeve; third springs may be provided in the second movement grooves; the third springs may be provided between the pressing portions and the vertical bars of the front U-shaped support frame; and the backrest may be provided between the top of the left rod sleeve and the top of the right rod sleeve.

Further, two top ends of the front U-shaped support frame may be provided with hinge portions; two top ends of the rear U-shaped support frame respectively correspond to the hinge portions; the hinge portions extend into corresponding tops of the rear U-shaped support frame; a button groove may be provided on a side surface of each of the two top ends of the rear U-shaped support frame; a button may be provided in the button groove; a plurality of abutting rods may be provided on a side surface of the button; a first gear groove may be provided in each of the two top ends of the rear U-shaped support frame; a side surface of each of the hinge portions may be provided with a second gear groove; a gear may be provided in each of the two top ends of the rear U-shaped support frame; one half of the gear may be located in the first gear groove, and the other half of the gear may be located in the second gear groove; a fourth spring abutting against the gear may be provided in the second gear groove; and the plurality of abutting rods pass through the button groove to abut against the gear.

Further, two bottom ends of the front U-shaped support frame and two bottom ends of the rear U-shaped support frame may be provided with rope buckles.

According to the description of the present invention, compared with the prior art, the present invention has the following advantages.

1. The present invention has a novel structure and clever design. The front U-shaped support frame and the rear U-shaped support frame are arranged in a foldable manner, and the seat and the front U-shaped support frame are arranged in a foldable manner, which reduces the storage space of the dining chair after being folded. In addition, the dining tray is rotatable to open, which is convenient for a child to get in and out of the seat.

2. The seat is height-adjustable and can be used with tables and chairs of different heights. The left armrest and the right armrest are arranged in a foldable manner, further reducing the storage space. In addition, the rope buckles are used for a rope to pass through to firmly fix the low chair to an adult chair.

DETAILED DESCRIPTION OF THE EMBODIMENTS

Figure 1:
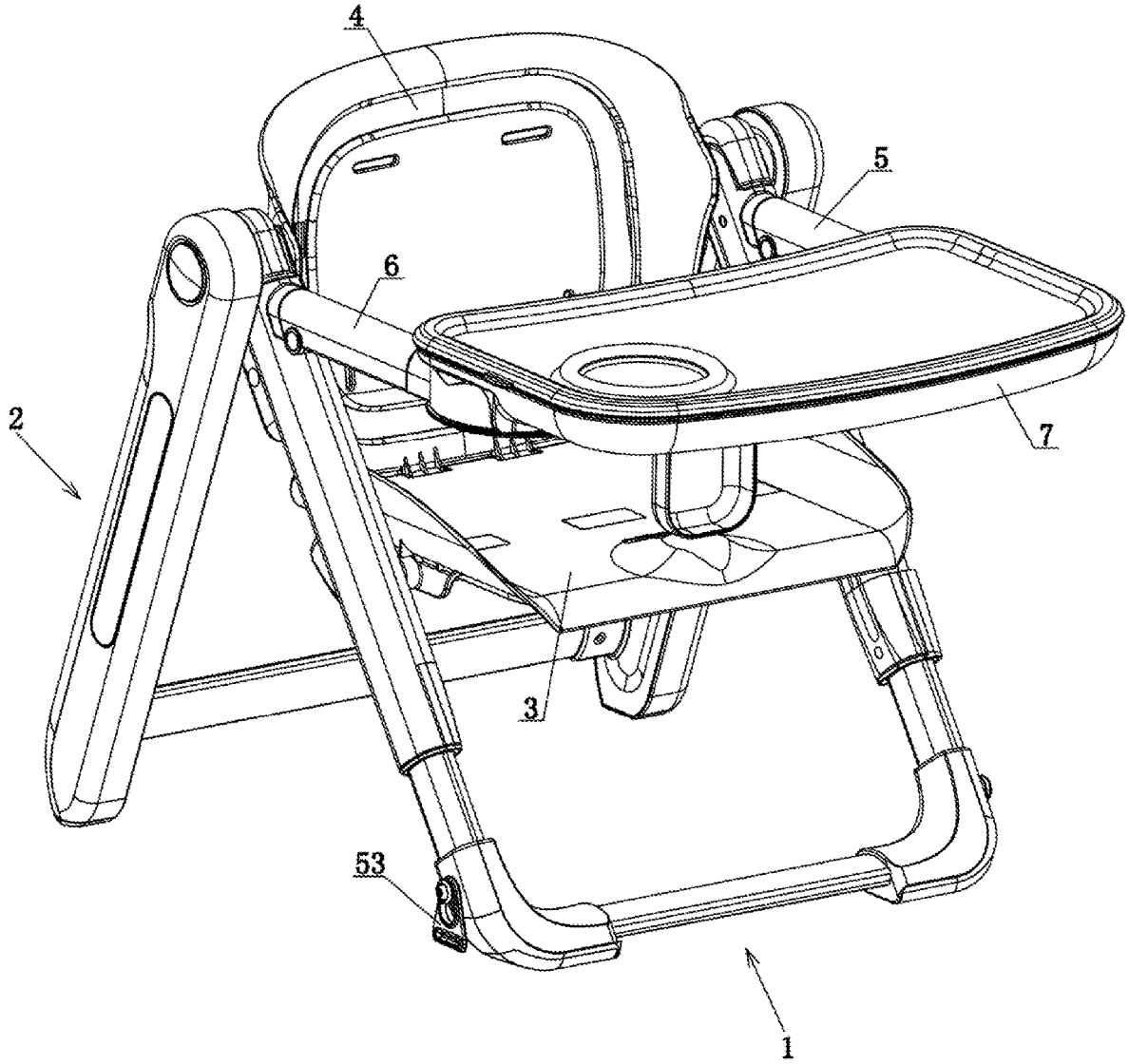
FIG. 1 is a structural view of a multifunctional small dining chair according to the present invention.
Figure 2:
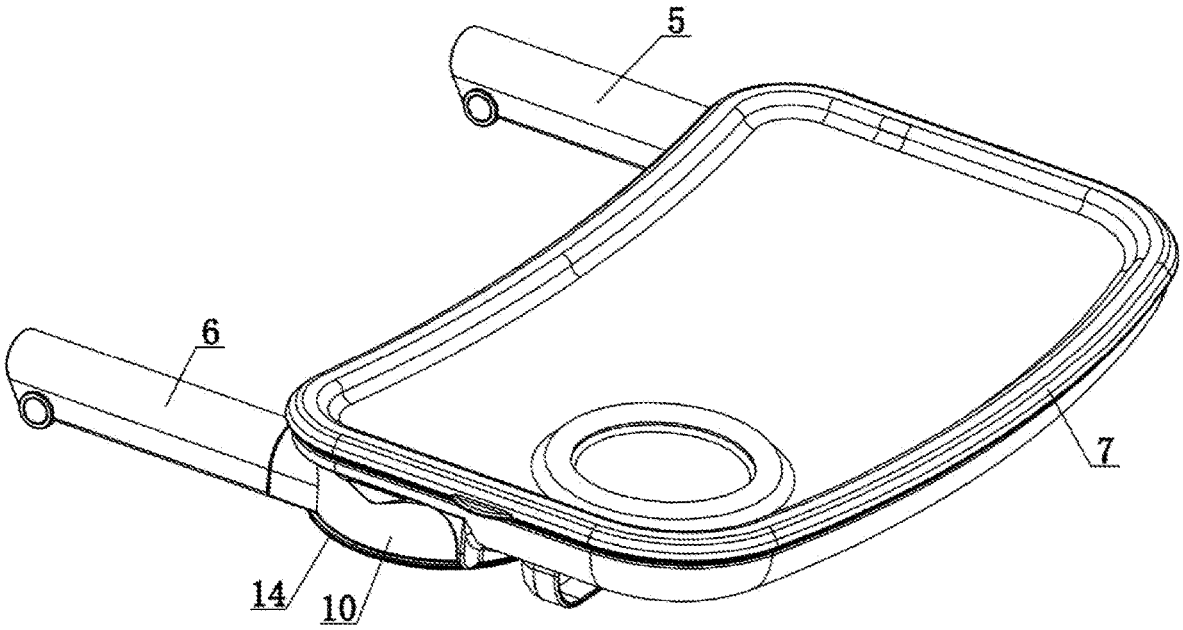
FIG. 2 is a structural view of a dining tray connected to a left armrest and a right armrest according to the present invention.

Referring to FIG. 1, a multifunctional small dining chair includes a front U-shaped support frame 1, a rear U-shaped support frame 2, a seat 3, a backrest 4, a left armrest 5, a right armrest 6 and a dining tray 7. A top of the front U-shaped support frame 1 and a top of the rear U-shaped support frame 2 are arranged in a foldable manner. The seat 3 and the backrest 4 are arranged inside the front U-shaped support frame 1. The seat 3 and the front U-shaped support frame 1 are arranged in a foldable manner. A bottom end of the backrest 4 and a rear end of the seat 3 are hinged. A rear end of the left armrest 5 and a rear end of the right armrest 6 are connected to an upper front end of the front U-shaped support frame 1. The dining tray 7 is provided between the left armrest 5 and the right armrest 6, and the dining tray 7 is rotatable relative to the left armrest 5 or the right armrest 6. The dining tray 7 is detachably connected to the left armrest 5 and the right armrest 6.

Referring to FIGS. 1 to 4, a bottom of the dining tray 7 is provided with a left inserting rod 8 and a right inserting rod 9. A front end of the left armrest 5 is provided with a left rod groove 51 into which the left inserting rod 8 is inserted, and a front end of the right armrest 6 is provided with a right rod groove 61 into which the right inserting rod 9 is inserted. A front end of the right inserting rod 9 is provided with a disc 10. A right bottom end of the dining tray 7 is provided with a disc groove 11 adapted to the disc 10, and the disc 10 is located in the disc groove 11. A right end of the disc groove 11 is open. The disc 10 is open-top and hollow inside. Three arc-shaped through grooves 12 are uniformly arranged on a bottom of the disc 10. A protruding post 13 is provided at a center of an inner bottom surface of the disc 10. The protruding post is provided with a shaft hole 131 being vertically hollow. A bottom cover 14 is provided under the disc 10. A top surface of the bottom cover 14 is provided with a lower shaft post 15 and three threaded posts 16. An inner top surface of the disc groove 11 is provided with an upper shaft post 17 and three connecting posts 18. The lower shaft post 15 is located at a center of the top surface of the bottom cover 14. The upper shaft post 17 is located at a center of the inner top surface of the disc groove 11. A bottom of the upper shaft post 17 is provided with a first post hole 171. A top of the lower shaft post 15 passes through the shaft hole 131 to be located in the first post hole 171. A bottom surface of each of the connecting posts 18 is provided with a second post hole 181. Each threaded post 16 corresponds to one arc-shaped through groove 12 and one connecting post 18. A top of each threaded post 16 passes through a corresponding arc-shaped through groove 12 to be located in a corresponding second post hole 181. The corresponding connecting post 18 and threaded post 16 are connected by a screw.

Figure 3:
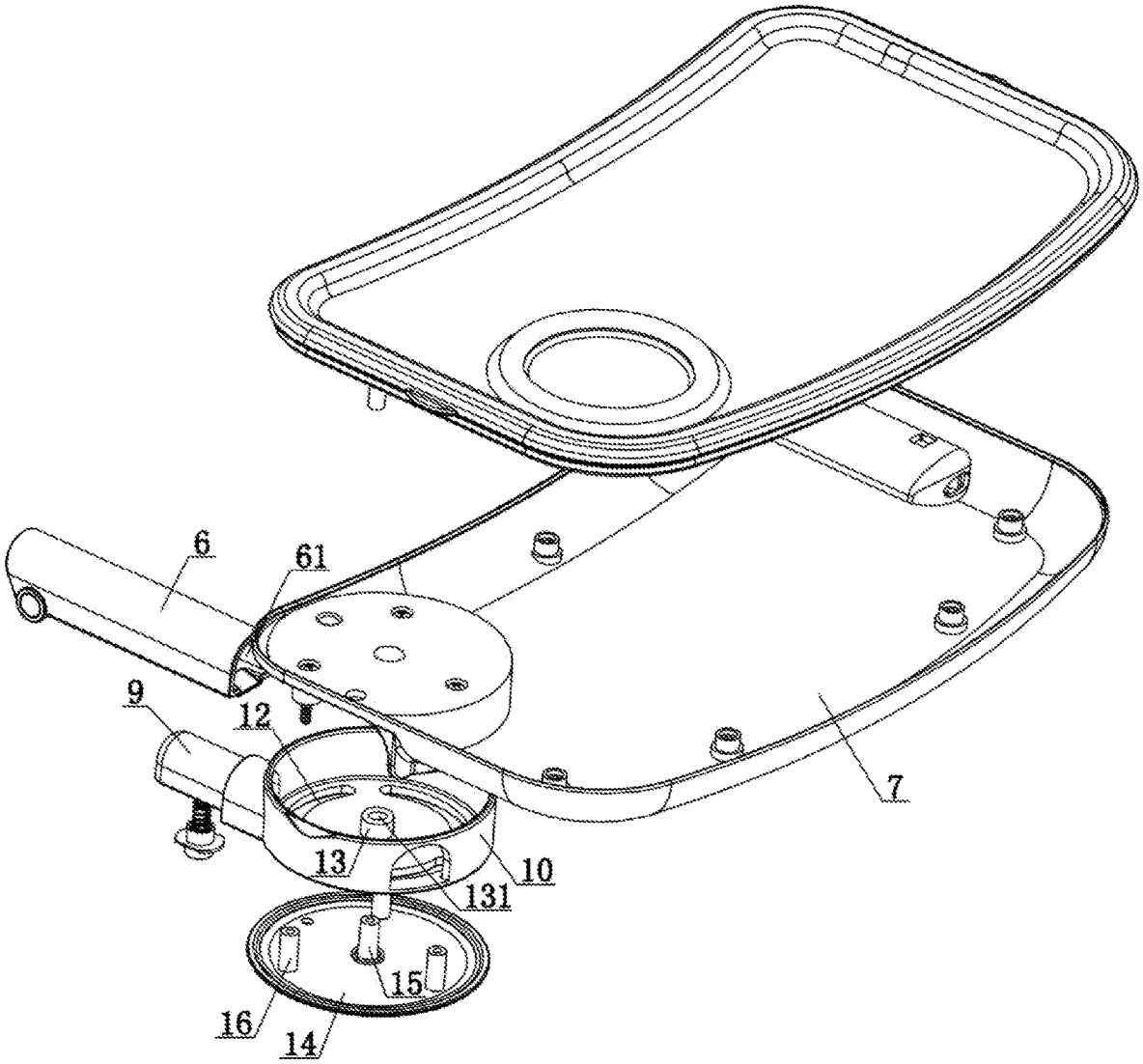
FIG. 3 is an exploded view of the structure shown in FIG. 2.
Figure 4:
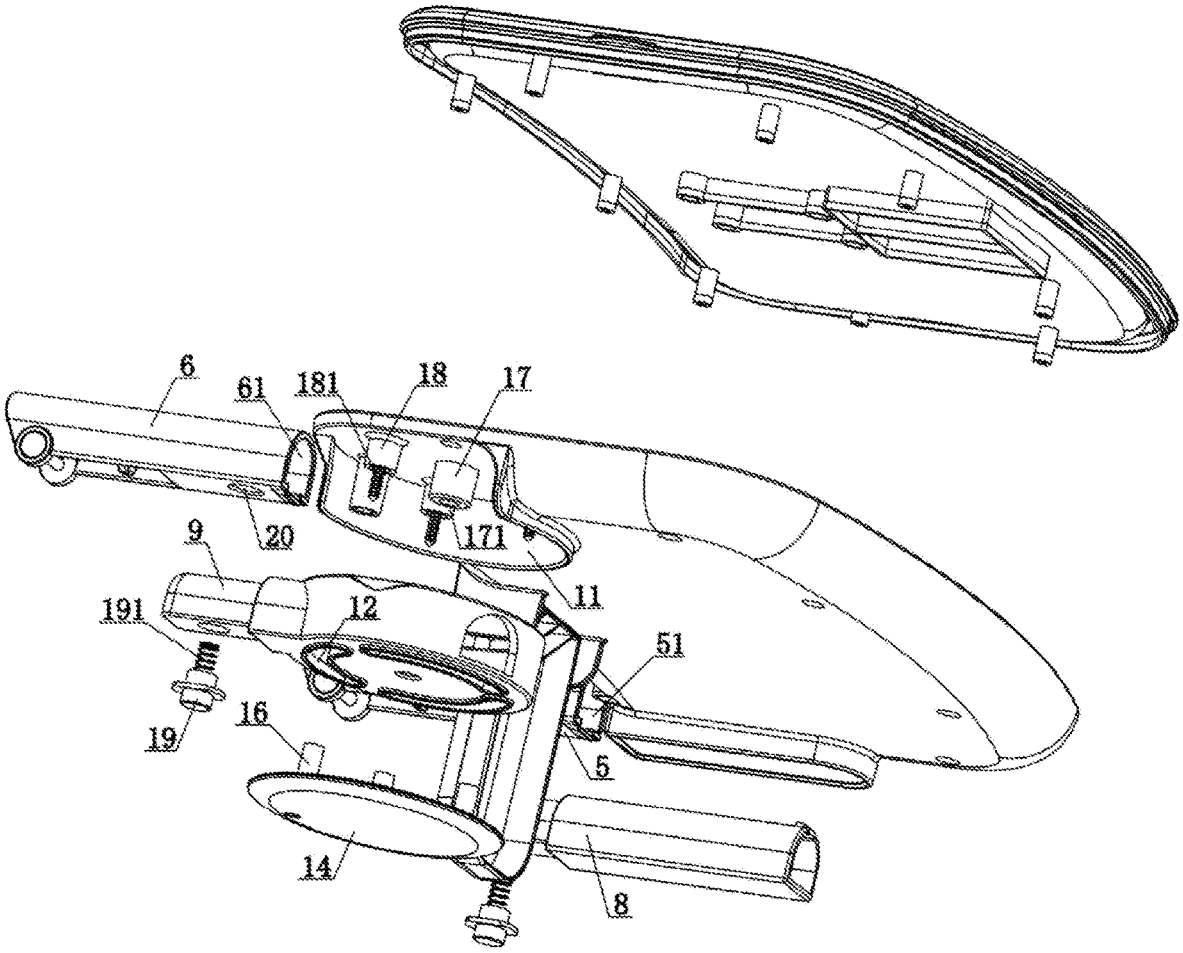
FIG. 4 is a view of the structure shown in FIG. 3 from another angle.

Referring to FIGS. 3 and 4, each of the left inserting rod 8 and the right inserting rod 9 is provided with an elastic clamping button 19. A bottom of the clamping button 19 passes through a bottom of each of the left inserting rod 8 and the right inserting rod 9. Each of a bottom surface of the left armrest 5 and a bottom surface of the right armrest 6 is provided with a clamping button groove 20. The bottom of the clamping button 19 is located in the clamping button groove 20. A spring 191 abutting against the clamping button 19 is provided in the left inserting rod 8 and the right inserting rod 9.

Referring to FIGS. 1 to 4, the dining tray 7 is rotatable relative to the right armrest 6. When the dining tray 7 needs to be rotated, the clamping button 19 in the left inserting rod 8 is pressed, such that the clamping button 19 is separated from the clamping button groove 20 on the left armrest 5. Then, the left inserting rod 8 is withdrawn from the left rod groove 51 to rotate the dining tray 7. The threaded posts 16 pass through the arc-shaped through grooves 12 to limit a rotation angle of the dining tray. In this embodiment, the dining tray 7 can be rotated by 90°.

Figure 5:
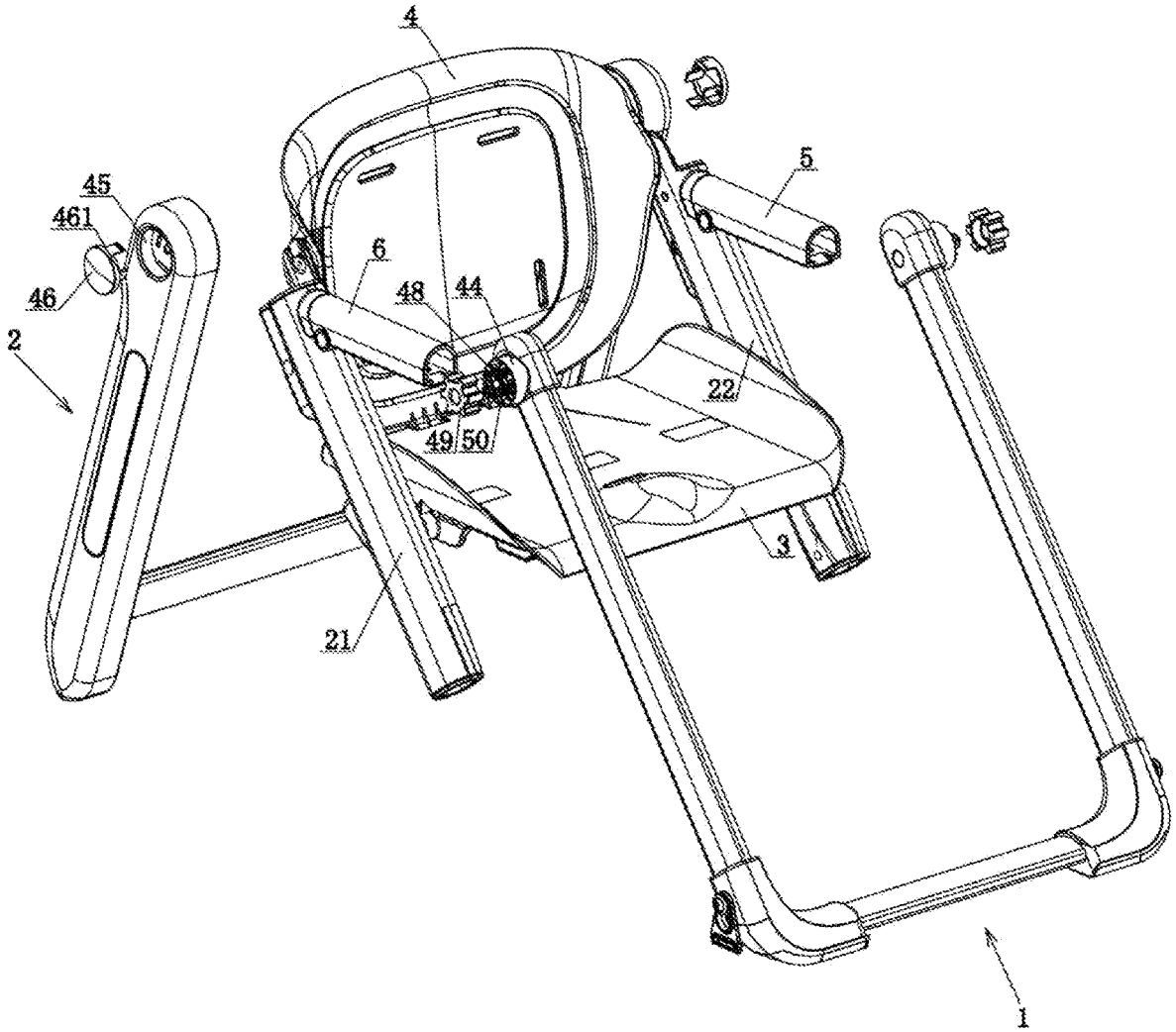
FIG. 5 is an exploded view excluding the dining tray according to the present invention.

Referring to FIGS. 1 and 5, two vertical bars of the front U-shaped support frame 1 are respectively nested in a left rod sleeve 21 and a right rod sleeve 22. The left rod sleeve 21 and the right rod sleeve 22 are respectively connected to the two vertical bars of the front U-shaped support frame 1 in a liftable manner.

Figure 7:
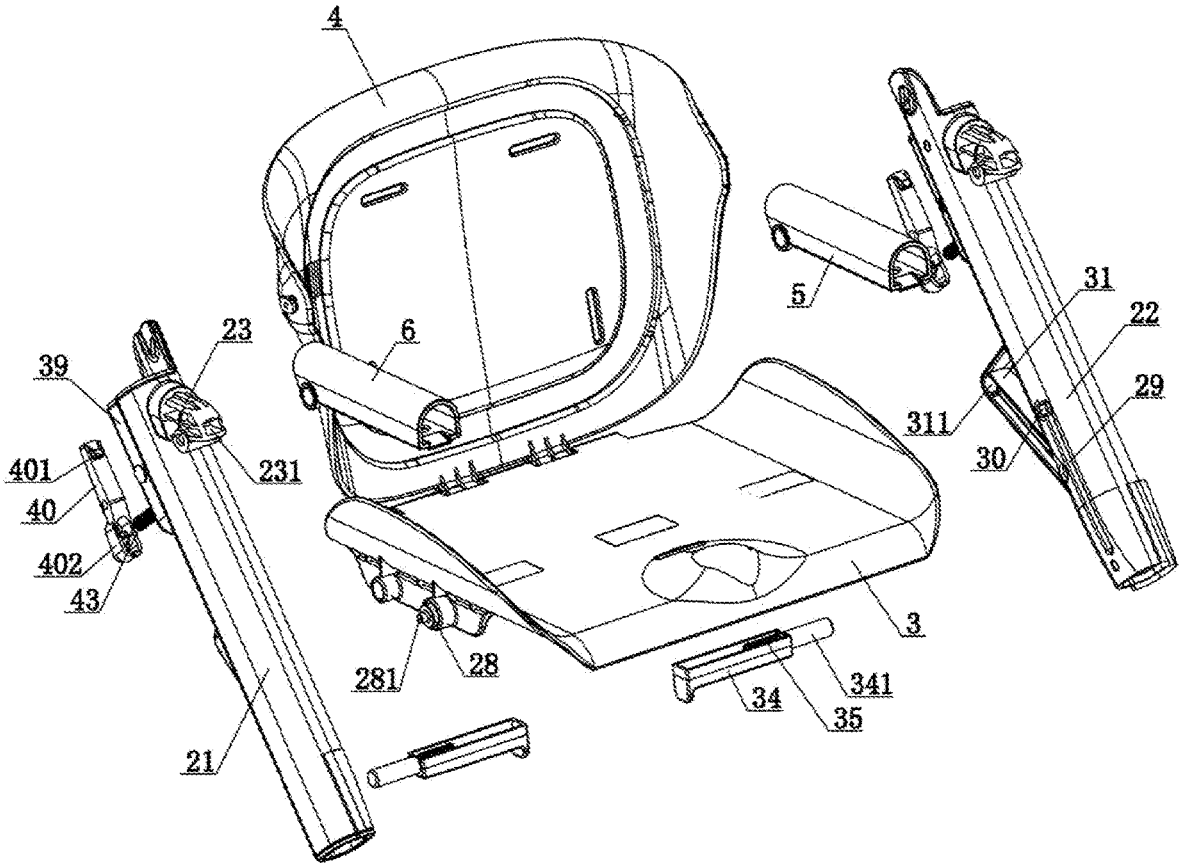
FIG. 7 is an exploded view excluding a front U-shaped support frame and a rear U-shaped support frame shown in FIG. 5.
Figure 8:
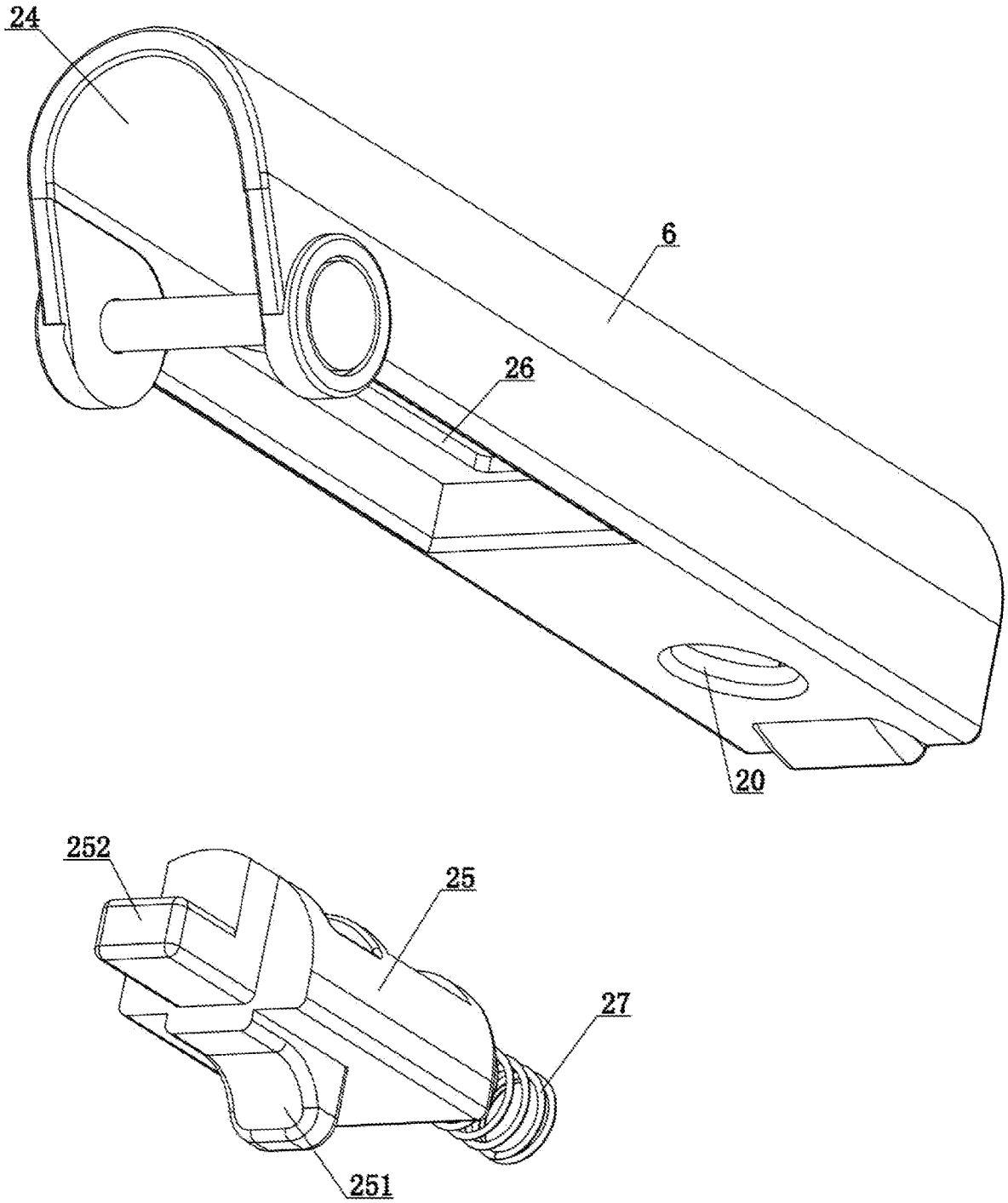
FIG. 8 is a structural view of the left armrest and the right armrest according to the present invention.

Referring to FIGS. 7 and 8, each of a front end surface of the left rod sleeve 21 and a front end surface of the right rod sleeve 22 is provided with a hinge joint 23. Each of the rear end of the left armrest 5 and the rear end of the right armrest 6 is provided with a hinge port 24. The hinge joint 23 is located in the hinge port 24 and hinged to the rear end of the left armrest 5 or the rear end of the right armrest 6. A front end surface of the hinge joint 23 is provided with a first clamping opening 231. A first movable member 25 is provided in the hinge port 24. A bottom of the first movable member 25 is provided with a push portion 251. Each of a rear bottom of the left armrest 5 and a rear bottom of the right armrest 6 is provided with a first movement groove 26. The push portion 251 extends out of the first movement groove 26. A rear end of the first movable member 25 is provided with a first clamping portion 252 inserted into the first clamping opening 231. A first spring 27 abutting against a front end of the first movable member 25 is provided in the hinge port 24.

Referring to FIGS. 7 and 8, the left armrest 5 and the right armrest 6 are arranged in a foldable manner. When the left armrest 5 and the right armrest 6 need to be folded, the first movable members 25 on the left armrest 5 and the right armrest 6 are pushed forward, such that the first clamping portions 252 are separated from the first clamping openings 231. Then the left armrest 5 and the right armrest 6 are pressed down to fold them.

Figure 9:
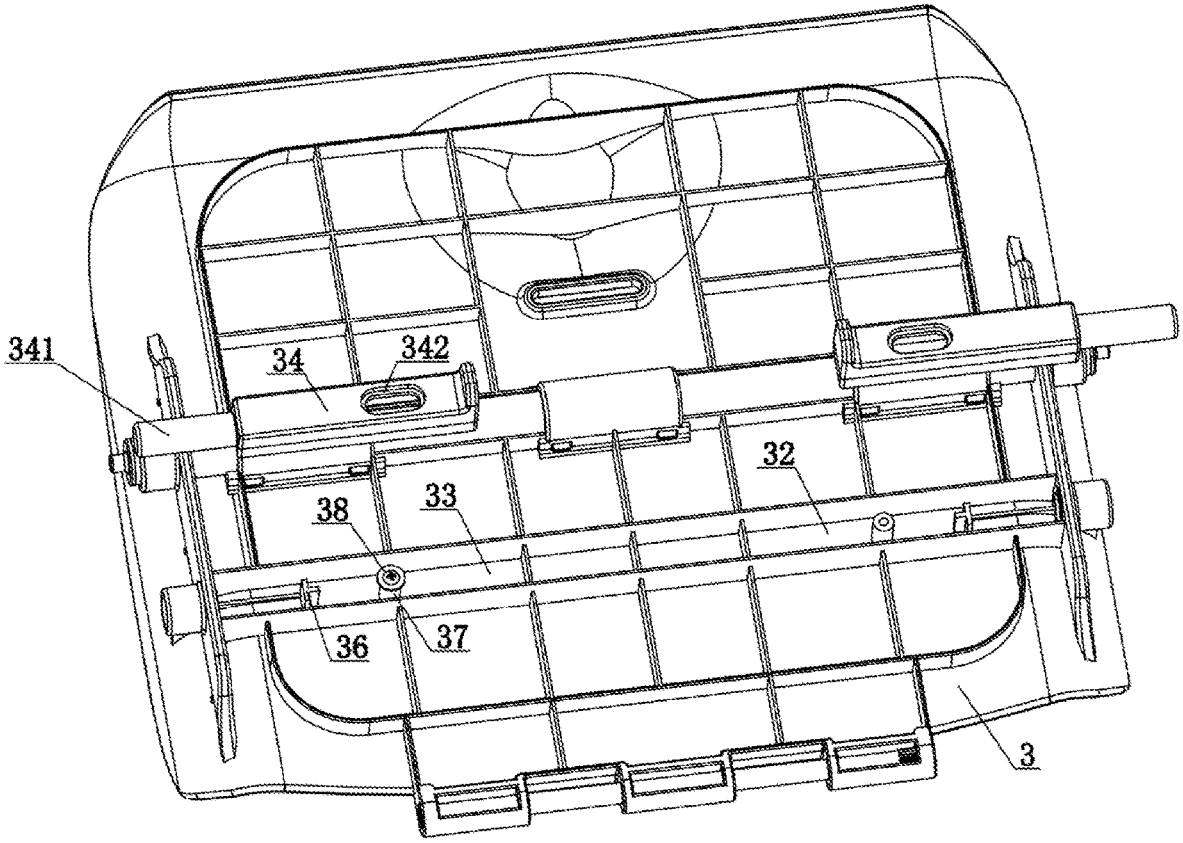
FIG. 9 is a structural view of a seat according to the present invention.

Referring to FIGS. 5, 7 and 9, a support rod 28 is provided at a middle of a bottom surface of the seat 3. Two ends of the support rod 28 are provided with clamping posts 281. A right side surface of the left rod sleeve 21 and a left side surface of the right rod sleeve 22 are provided with vertical sliding grooves 29. Tops of the vertical sliding grooves 29 are provided with horizontal clamping grooves 30 communicating with the vertical sliding grooves. The clamping posts 281 are located in the horizontal clamping grooves 30, and the clamping posts 281 slide along the vertical sliding grooves 29 when the seat 3 is folded. A rear end of the left rod sleeve 21 and a rear end of the right rod sleeve 22 are provided with extension portions 31. Each of the extension portions 31 is provided with a clamping hole 311. A left movement groove 32 and a right movement groove 33 are provided on the bottom surface of the seat 3. Second movable members 34 are provided in the left movement groove 32 and the right movement groove 33. One end of each of the second movable members 34 is provided with a clamping rod 341 inserted into the clamping hole 311. Each of the second movable members 34 are open-top and hollow inside. A second spring 35 is provided in the second movable members 34. Each of the left movement groove 32 and the right movement groove 33 is provided with an abutting portion 36 and a limiting post 37, where the abutting portion 36 and the limiting post 37 are located in each of the second movable members 34. The second spring 35 is provided between the clamping rod 341 and the abutting portion 36. A bottom surface of each of the second movable members 34 is provided with a step groove 342. A gasket 38 is provided in a bottom of the step groove 342. A bottom of the limiting post 37 is located inside an upper part of the step groove 342. Each of the second movable members 34 is connected to the limiting post 37 by a screw passing through the gasket 38.

Referring to FIGS. 5, 7 and 9, the seat 3 is foldable. When the seat 3 needs to be folded, the second movable members 34 in the left movement groove 32 and the right movement groove 33 are pulled, such that the clamping rods 341 are separated from the clamping holes 311. Then, the seat 3 is flipped downwards, such that the clamping posts 281 are separated from the horizontal clamping grooves 30 and slide along the vertical sliding grooves 29.

Figure 6:
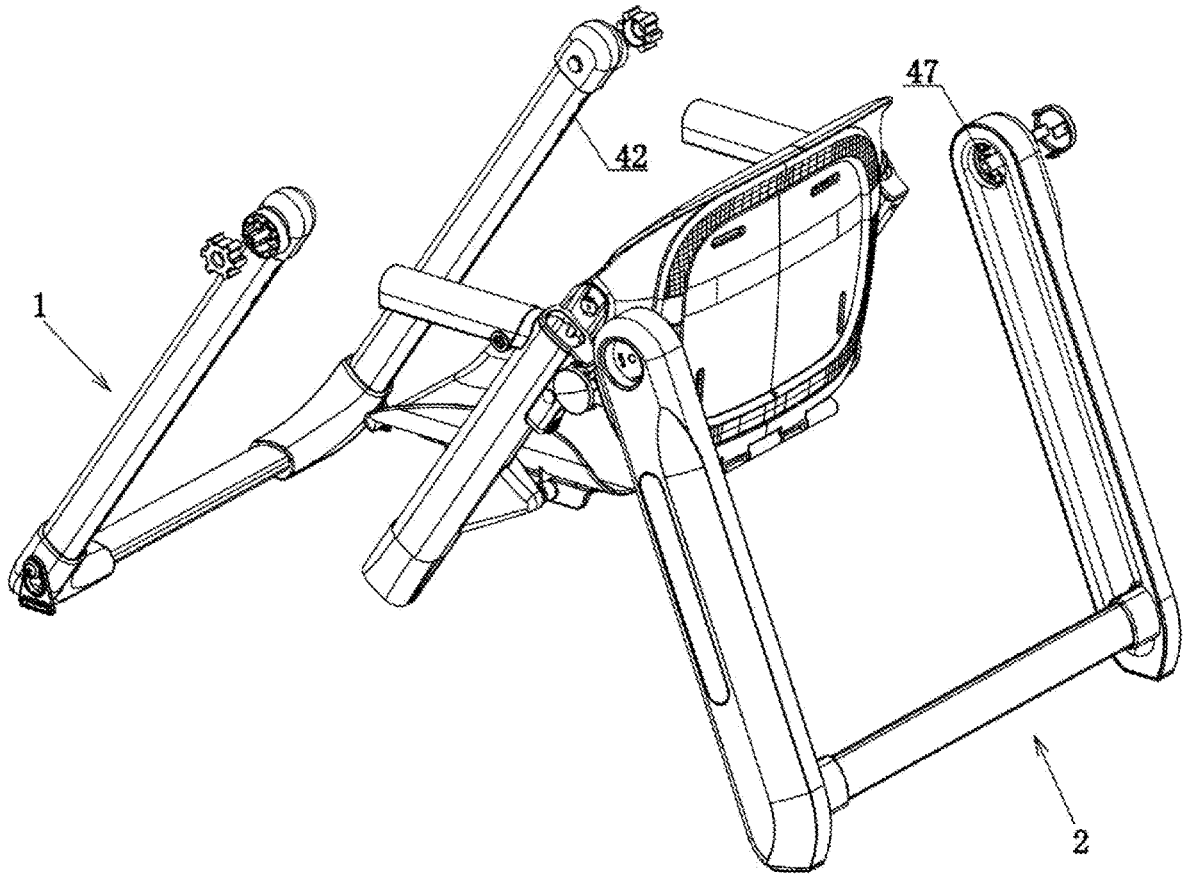
FIG. 6 is a view of the structure shown in FIG. 5 from another angle.

Referring to FIGS. 5 to 7, second movement grooves 39 are respectively provided in a top of the left rod sleeve 21 and a top of the right rod sleeve 22. Pressing rods 40 are respectively provided in the second movement grooves 39. Each of top front end surfaces of the pressing rods 40 is provided with a second clamping portion 401. Each of rear end surfaces of the two vertical bars of the front U-shaped support frame 1 is provided with a plurality of second clamping openings 42 from top to bottom into which the second clamping portion is clamped. Pressing portions 402 are provided at bottoms of the pressing rods 40. Rear ends of the pressing portions 402 respectively protrude out of a rear end surface of the corresponding left rod sleeve 21 and a rear end surface of the corresponding right rod sleeve 22. Third springs 43 are provided in the second movement grooves 39. The third springs 43 are provided between the pressing portions 402 and the vertical bars of the front U-shaped support frame 1. The backrest 4 is provided between the top of the left rod sleeve 21 and the top of the right rod sleeve 22.

Referring to FIGS. 5 to 7, the left rod sleeve 21 and the right rod sleeve 22 are height-adjustable, such that the seat 3 and the backrest 4 are also height-adjustable. When the heights of the left rod sleeve 21 and the right rod sleeve 22 need to be adjusted, the pressing portions 402 are pressed to disengage the second clamping portion 401 from the originally matched second clamping openings 42. Thus, the heights of the left rod sleeve 21 and the right rod sleeve 22 can be adjusted. When the left rod sleeve 21 and the right rod sleeve 22 are adjusted to required heights, the pressing portions 402 are released to allow the second clamping portion 401 to be clamped into new second clamping opening 42.

Referring to FIGS. 5 and 6, two top ends of the front U-shaped support frame 1 are provided with hinge portions 44. Two top ends of the rear U-shaped support frame 2 respectively correspond to the hinge portions 44. The hinge portions 44 extend into corresponding tops of the rear U-shaped support frame 2. A button groove 45 is provided on a side surface of each of the two top ends of the rear U-shaped support frame 2. A button 46 is provided in the button groove 45. A plurality of abutting rods 461 are provided on a side surface of the button 46. A first gear groove 47 is provided in each of the two top ends of the rear U-shaped support frame 2. A side surface of each of the hinge portions 44 is provided with a second gear groove 48. A gear 49 is provided in each of the two top ends of the rear U-shaped support frame 2. One half of the gear 49 is located in the first gear groove 47, and the other half of the gear 49 is located in the second gear groove 48. A fourth spring 50 abutting against the gears 49 is provided in the second gear groove 48. The plurality of abutting rods 461 pass through the button groove 45 to abut against the gear 49.

Referring to FIGS. 5 and 6, the front U-shaped support frame 1 and the rear U-shaped support frame 2 are arranged in a foldable manner. When the front U-shaped support frame 1 and the rear U-shaped support frame 2 need to be folded, the buttons 46 are pressed such that the abutting rods 461 push the gears 49 to move and disengage from the first gear grooves 47. Thus, the front U-shaped support frame 1 and the rear U-shaped support frame 2 can be folded.

Referring to FIG. 1, two bottom ends of the front U-shaped support frame 1 and two bottom ends of the rear U-shaped support frame 2 are provided with rope buckles 53. The rope buckles 53 are used for a rope to pass through to firmly fix the low chair to an adult chair.

The above described are merely specific implementations of the present invention, but the design concept of the present invention is not limited thereto. Any non-substantial changes made to the present invention based on the concept of the present invention should fall within the protection scope of the present invention.

What is claimed is:

1. A multifunctional small dining chair, comprising a front U-shaped support frame, a rear U-shaped support frame, a seat, a backrest, a left armrest, a right armrest and a dining tray, wherein a top of the front U-shaped support frame and a top of the rear U-shaped support frame are arranged in a foldable manner; the seat and the backrest are arranged inside the front U-shaped support frame; the seat and the front U-shaped support frame are arranged in a foldable manner; a bottom end of the backrest and a rear end of the seat are hinged; a rear end of the left armrest and a rear end of the right armrest are connected to an upper front end of the front U-shaped support frame; and the dining tray is provided between the left armrest and the right armrest, and the dining tray is rotatable relative to the left armrest or the right armrest, wherein the dining tray is detachably connected to the left armrest and the right armrest, and wherein a bottom of the dining tray is provided with a left inserting rod and a right inserting rod; a front end of the left armrest is provided with a left rod groove, wherein the left inserting rod is inserted into the left rod groove; a front end of the right armrest is provided with a right rod groove, wherein the right inserting rod is inserted into the right rod groove; a front end of the right inserting rod is provided with a disc; a right bottom end of the dining tray is provided with a disc groove adapted to the disc, and the disc is located in the disc groove; a right end of the disc groove is open; the disc is open-top and hollow inside; three arc-shaped through grooves are uniformly arranged on a bottom of the disc; a protruding post is provided at a center of an inner bottom surface of the disc; the protruding post is provided with a shaft hole being vertically hollow; a bottom cover is provided under the disc; a top surface of the bottom cover is provided with a lower shaft post and three threaded posts; an inner top surface of the disc groove is provided with an upper shaft post and three connecting posts; the lower shaft post is located at a center of the top surface of the bottom cover; the upper shaft post is located at a center of the inner top surface of the disc groove; a bottom of the upper shaft post is provided with a first post hole; a top of the lower shaft post passes through the shaft hole to be located in the first post hole; a bottom surface of each connecting post of the three connecting posts is provided with a second post hole; each threaded post of the three threaded posts corresponds to one arc-shaped through groove and one connecting post; a top of each threaded post passes through an arc-shaped through groove corresponding to each threaded post to be located in a second post hole corresponding to each threaded post; and each connecting post and each threaded post corresponding to each connecting post are connected by a screw.

2. The multifunctional small dining chair according to claim 1, wherein each of the left inserting rod and the right inserting rod is provided with an elastic clamping button; a bottom of the elastic clamping button passes through a bottom of each of the left inserting rod and the right inserting rod; each of a bottom surface of the left armrest and a bottom surface of the right armrest is provided with a clamping button groove; and the bottom of the elastic clamping button is located in the clamping button groove.

3. The multifunctional small dining chair according to claim 1, wherein two vertical bars of the front U-shaped support frame are respectively nested in a left rod sleeve and a right rod sleeve; and the left rod sleeve and the right rod sleeve are respectively connected to the two vertical bars of the front U-shaped support frame in a liftable manner.

4. The multifunctional small dining chair according to claim 3, wherein each of a front end surface of the left rod sleeve and a front end surface of the right rod sleeve is provided with a hinge joint; each of the rear end of the left armrest and the rear end of the right armrest is provided with a hinge port; the hinge joint is located in the hinge port and hinged to each of the rear end of the left armrest and the rear end of the right armrest; a front end surface of the hinge joint is provided with a first clamping opening; a first movable member is provided in the hinge port; a bottom of the first movable member is provided with a push portion; each of a rear bottom of the left armrest and a rear bottom of the right armrest is provided with a first movement groove; the push portion extends out of the first movement groove; a rear end of the first movable member is provided with a first clamping portion inserted into the first clamping opening; and a first spring abutting against a front end of the first movable member is provided in the hinge port.

5. The multifunctional small dining chair according to claim 3, wherein a support rod is provided at a middle of a bottom surface of the seat; two ends of the support rod are provided with clamping posts; a right side surface of the left rod sleeve and a left side surface of the right rod sleeve are provided with vertical sliding grooves; tops of the vertical sliding grooves are provided with horizontal clamping grooves communicating with the vertical sliding grooves; the clamping posts are located in the horizontal clamping grooves, and the clamping posts slide along the vertical sliding grooves when the seat is folded; a rear end of the left rod sleeve and a rear end of the right rod sleeve are provided with extension portions; each of the extension portions is provided with a clamping hole; a left movement groove and a right movement groove are provided on the bottom surface of the seat; second movable members are provided in the left movement groove and the right movement groove; one end of each of the second movable members is provided with a clamping rod inserted into the clamping hole; the second movable members are open-top and hollow inside; a second spring is provided in each of the second movable members; each of the left movement groove and the right movement groove is provided with an abutting portion and a limiting post, wherein the abutting portion and the limiting post are located in each of the second movable members; the second spring is provided between the clamping rod and the abutting portion; a bottom surface of each of the second movable members is provided with a step groove; a gasket is provided in a bottom of the step groove; a bottom of the limiting post is located inside an upper part of the step groove; and each of the second movable members is connected to the limiting post by a screw passing through the gasket.

6. The multifunctional small dining chair according to claim 3, wherein second movement grooves are respectively provided in a top of the left rod sleeve and a top of the right rod sleeve; pressing rods are respectively provided in the second movement grooves; each of top front end surfaces of the pressing rods is provided with a second clamping portion; each of rear end surfaces of the two vertical bars of the front U-shaped support frame is provided with a plurality of second clamping openings from top to bottom, wherein the second clamping portion is clamped into the plurality of second clamping openings; pressing portions are provided at bottoms of the pressing rods; rear ends of the pressing portions respectively protrude out of a rear end surface of the left rod sleeve and a rear end surface of the right rod sleeve; third springs are provided in the second movement grooves; each of the third springs is provided between each of the pressing portions and each of the two vertical bars of the front U-shaped support frame; and the backrest is provided between the top of the left rod sleeve and the top of the right rod sleeve.

7. The multifunctional small dining chair according to claim 1, wherein two top ends of the front U-shaped support frame are provided with hinge portions; two top ends of the rear U-shaped support frame respectively correspond to the hinge portions; the hinge portions extend into corresponding tops of the rear U-shaped support frame; a button groove is provided on a side surface of each of the two top ends of the rear U-shaped support frame; a button is provided in the button groove; a plurality of abutting rods are provided on a side surface of the button; a first gear groove is provided in each of the two top ends of the rear U-shaped support frame; a side surface of each of the hinge portions is provided with a second gear groove; a gear is provided in each of the two top ends of the rear U-shaped support frame; one half of the gear is located in the first gear groove, and the other half of the gear is located in the second gear groove; a fourth spring abutting against the gear is provided in the second gear groove; and the plurality of abutting rods pass through the button groove to abut against the gear.

8. The multifunctional small dining chair according to claim 1, wherein two bottom ends of the front U-shaped support frame and two bottom ends of the rear U-shaped support frame are provided with rope buckles.

9. A multifunctional small dining chair, comprising a front U-shaped support frame, a rear U-shaped support frame, a seat, a backrest, a left armrest, a right armrest and a dining tray, wherein a top of the front U-shaped support frame and a top of the rear U-shaped support frame are arranged in a foldable manner; the seat and the backrest are arranged inside the front U-shaped support frame; the seat and the front U-shaped support frame are arranged in a foldable manner; a bottom end of the backrest and a rear end of the seat are hinged; a rear end of the left armrest and a rear end of the right armrest are connected to an upper front end of the front U-shaped support frame; and the dining tray is provided between the left armrest and the right armrest, and the dining tray is rotatable relative to the left armrest or the right armrest, wherein two vertical bars of the front U-shaped support frame are respectively nested in a left rod sleeve and a right rod sleeve; and the left rod sleeve and the right rod sleeve are respectively connected to the two vertical bars of the front U-shaped support frame in a liftable manner, and wherein each of a front end surface of the left rod sleeve and a front end surface of the right rod sleeve is provided with a hinge joint; each of the rear end of the left armrest and the rear end of the right armrest is provided with a hinge port; the hinge joint is located in the hinge port and hinged to each of the rear end of the left armrest and the rear end of the right armrest; a front end surface of the hinge joint is provided with a first clamping opening; a first movable member is provided in the hinge port; a bottom of the first movable member is provided with a push portion; each of a rear bottom of the left armrest and a rear bottom of the right armrest is provided with a first movement groove; the push portion extends out of the first movement groove; a rear end of the first movable member is provided with a first clamping portion inserted into the first clamping opening; and a first spring abutting against a front end of the first movable member is provided in the hinge port.

10. The multifunctional small dining chair according to claim 9, wherein the dining tray is detachably connected to the left armrest and the right armrest.

11. The multifunctional small dining chair according to claim 10, wherein a bottom of the dining tray is provided with a left inserting rod and a right inserting rod; a front end of the left armrest is provided with a left rod groove, wherein the left inserting rod is inserted into the left rod groove; a front end of the right armrest is provided with a right rod groove, wherein the right inserting rod is inserted into the right rod groove; a front end of the right inserting rod is provided with a disc; a right bottom end of the dining tray is provided with a disc groove adapted to the disc, and the disc is located in the disc groove; a right end of the disc groove is open; the disc is open-top and hollow inside; three arc-shaped through grooves are uniformly arranged on a bottom of the disc; a protruding post is provided at a center of an inner bottom surface of the disc; the protruding post is provided with a shaft hole being vertically hollow; a bottom cover is provided under the disc; a top surface of the bottom cover is provided with a lower shaft post and three threaded posts; an inner top surface of the disc groove is provided with an upper shaft post and three connecting posts; the lower shaft post is located at a center of the top surface of the bottom cover; the upper shaft post is located at a center of the inner top surface of the disc groove; a bottom of the upper shaft post is provided with a first post hole; a top of the lower shaft post passes through the shaft hole to be located in the first post hole; a bottom surface of each connecting post of the three connecting posts is provided with a second post hole; each threaded post of the three threaded posts corresponds to one arc-shaped through groove and one connecting post; a top of each threaded post passes through an arc-shaped through groove corresponding to each threaded post to be located in a second post hole corresponding to each threaded post; and each connecting post and each threaded post corresponding to each connecting post are connected by a screw.

12. The multifunctional small dining chair according to claim 11, wherein each of the left inserting rod and the right inserting rod is provided with an elastic clamping button; a bottom of the elastic clamping button passes through a bottom of each of the left inserting rod and the right inserting rod; each of a bottom surface of the left armrest and a bottom surface of the right armrest is provided with a clamping button groove; and the bottom of the elastic clamping button is located in the clamping button groove.

13. The multifunctional small dining chair according to claim 9, wherein a support rod is provided at a middle of a bottom surface of the seat; two ends of the support rod are provided with clamping posts; a right side surface of the left rod sleeve and a left side surface of the right rod sleeve are provided with vertical sliding grooves; tops of the vertical sliding grooves are provided with horizontal clamping grooves communicating with the vertical sliding grooves; the clamping posts are located in the horizontal clamping grooves, and the clamping posts slide along the vertical sliding grooves when the seat is folded; a rear end of the left rod sleeve and a rear end of the right rod sleeve are provided with extension portions; each of the extension portions is provided with a clamping hole; a left movement groove and a right movement groove are provided on the bottom surface of the seat; second movable members are provided in the left movement groove and the right movement groove; one end of each of the second movable members is provided with a clamping rod inserted into the clamping hole; the second movable members are open-top and hollow inside; a second spring is provided in each of the second movable members; each of the left movement groove and the right movement groove is provided with an abutting portion and a limiting post, wherein the abutting portion and the limiting post are located in each of the second movable members; the second spring is provided between the clamping rod and the abutting portion; a bottom surface of each of the second movable members is provided with a step groove; a gasket is provided in a bottom of the step groove; a bottom of the limiting post is located inside an upper part of the step groove; and each of the second movable members is connected to the limiting post by a screw passing through the gasket.

14. The multifunctional small dining chair according to claim 9, wherein second movement grooves are respectively provided in a top of the left rod sleeve and a top of the right rod sleeve; pressing rods are respectively provided in the second movement grooves; each of top front end surfaces of the pressing rods is provided with a second clamping portion; each of rear end surfaces of the two vertical bars of the front U-shaped support frame is provided with a plurality of second clamping openings from top to bottom, wherein the second clamping portion is clamped into the plurality of second clamping openings; pressing portions are provided at bottoms of the pressing rods; rear ends of the pressing portions respectively protrude out of a rear end surface of the left rod sleeve and a rear end surface of the right rod sleeve; third springs are provided in the second movement grooves; each of the third springs is provided between each of the pressing portions and each of the two vertical bars of the front U-shaped support frame; and the backrest is provided between the top of the left rod sleeve and the top of the right rod sleeve.

15. The multifunctional small dining chair according to claim 9, wherein two top ends of the front U-shaped support frame are provided with hinge portions; two top ends of the rear U-shaped support frame respectively correspond to the hinge portions; the hinge portions extend into corresponding tops of the rear U-shaped support frame; a button groove is provided on a side surface of each of the two top ends of the rear U-shaped support frame; a button is provided in the button groove; a plurality of abutting rods are provided on a side surface of the button; a first gear groove is provided in each of the two top ends of the rear U-shaped support frame; a side surface of each of the hinge portions is provided with a second gear groove; a gear is provided in each of the two top ends of the rear U-shaped support frame; one half of the gear is located in the first gear groove, and the other half of the gear is located in the second gear groove; a fourth spring abutting against the gear is provided in the second gear groove; and the plurality of abutting rods pass through the button groove to abut against the gear.

16. The multifunctional small dining chair according to claim 9, wherein two bottom ends of the front U-shaped support frame and two bottom ends of the rear U-shaped support frame are provided with rope buckles.

17. A multifunctional small dining chair, comprising a front U-shaped support frame, a rear U-shaped support frame, a seat, a backrest, a left armrest, a right armrest and a dining tray, wherein a top of the front U-shaped support frame and a top of the rear U-shaped support frame are arranged in a foldable manner; the seat and the backrest are arranged inside the front U-shaped support frame; the seat and the front U-shaped support frame are arranged in a foldable manner; a bottom end of the backrest and a rear end of the seat are hinged; a rear end of the left armrest and a rear end of the right armrest are connected to an upper front end of the front U-shaped support frame; and the dining tray is provided between the left armrest and the right armrest, and the dining tray is rotatable relative to the left armrest or the right armrest, wherein two vertical bars of the front U-shaped support frame are respectively nested in a left rod sleeve and a right rod sleeve; and the left rod sleeve and the right rod sleeve are respectively connected to the two vertical bars of the front U-shaped support frame in a liftable manner, and wherein second movement grooves are respectively provided in a top of the left rod sleeve and a top of the right rod sleeve; pressing rods are respectively provided in the second movement grooves; each of top front end surfaces of the pressing rods is provided with a second clamping portion; each of rear end surfaces of the two vertical bars of the front U-shaped support frame is provided with a plurality of second clamping openings from top to bottom, wherein the second clamping portion is clamped into the plurality of second clamping openings; pressing portions are provided at bottoms of the pressing rods; rear ends of the pressing portions respectively protrude out of a rear end surface of the left rod sleeve and a rear end surface of the right rod sleeve; third springs are provided in the second movement grooves; each of the third springs is provided between each of the pressing portions and each of the two vertical bars of the front U-shaped support frame; and the backrest is provided between the top of the left rod sleeve and the top of the right rod sleeve.

18. The multifunctional small dining chair according to claim 17, wherein the dining tray is detachably connected to the left armrest and the right armrest.

19. The multifunctional small dining chair according to claim 17, wherein two top ends of the front U-shaped support frame are provided with hinge portions; two top ends of the rear U-shaped support frame respectively correspond to the hinge portions; the hinge portions extend into corresponding tops of the rear U-shaped support frame; a button groove is provided on a side surface of each of the two top ends of the rear U-shaped support frame; a button is provided in the button groove; a plurality of abutting rods are provided on a side surface of the button; a first gear groove is provided in each of the two top ends of the rear U-shaped support frame; a side surface of each of the hinge portions is provided with a second gear groove; a gear is provided in each of the two top ends of the rear U-shaped support frame; one half of the gear is located in the first gear groove, and the other half of the gear is located in the second gear groove; a fourth spring abutting against the gear is provided in the second gear groove; and the plurality of abutting rods pass through the button groove to abut against the gear.

20. The multifunctional small dining chair according to claim 17, wherein two bottom ends of the front U-shaped support frame and two bottom ends of the rear U-shaped support frame are provided with rope buckles.

* * * * *